United States Patent [19]

Seele

[11] Patent Number: 4,872,654

[45] Date of Patent: Oct. 10, 1989

[54] WORK-HOLDING IMPLEMENT AND BENCH-MOUNTED LOADING FIXTURE THEREFOR

[76] Inventor: Harold A. Seele, 6636 Sherbourne Dr., Los Angeles, Calif. 90056

[21] Appl. No.: 156,991

[22] Filed: Feb. 18, 1988

[51] Int. Cl.[4] ..... B25B 13/52

[52] U.S. Cl. ..... 269/3; 269/130; 269/254 R; 269/287; 81/64

[58] Field of Search ..... 81/64, 3.43, 3.4, 57.17, 81/65; 294/31.2, 33, 99.1, 19.2; 269/254 R, 287, 130–132, 3; 279/49; 273/160 E

[56] References Cited

U.S. PATENT DOCUMENTS

| | | | |
|---|---|---|---|
| 531,347 | 12/1894 | Varney | 294/99.1 |
| 648,060 | 4/1900 | Yorty | 81/64 |
| 721,196 | 2/1903 | Jeffreys | 294/19.2 |
| 1,722,519 | 7/1929 | Duchene | 273/162 E |
| 1,774,201 | 8/1930 | Jenkins | 81/3.43 |
| 2,132,207 | 10/1938 | Donovan | 81/3.43 |
| 2,593,498 | 4/1952 | Stone | 81/64 |
| 3,520,569 | 7/1970 | Anderson | 294/19.2 |
| 3,957,298 | 5/1976 | Purchase | 294/99.2 |
| 4,150,592 | 4/1979 | Mott | 81/64 |
| 4,687,204 | 8/1987 | Lempid | 294/19.2 |

FOREIGN PATENT DOCUMENTS

| | | | |
|---|---|---|---|
| 488360 | 6/1918 | France | 81/64 |

*Primary Examiner*—Robert C. Watson
*Attorney, Agent, or Firm*—Henry M. Bissell

[57] ABSTRACT

A work-holding implement for use in honing or otherwise machining the inner surface of a bore in a workpiece comprises a torsion-carrying spring band coil mounted at one end of a handle. Most of the inwardly exposed surface of the innermost turn of the coil is a gripping surface, while the remaining turns in the coil have smooth bearing surfaces. A workpiece is gripped by the innermost turn, and as an interior bore in the workpiece is being honed or otherwise machined, rotational torques exerted on the workpiece by the machine tool cause the coil to become more tightly wound around the workpiece. As the workpiece is being worked on, the tightened coil bears against a planar segment of the spring band forming part of the implement and deforms it into a curved surface conforming to the workpiece surface over which contact is made. Two control guides serve to keep the turns of the coil in alignment for proper pressure distribution of the innermost coil in its contact with the outer circumference of the workpiece. A loading fixture for use in conjunction with the work-holding implement allows quick and easy insertion and removal of a workpiece with safe and sure frictional engagement of the workpiece.

9 Claims, 2 Drawing Sheets

WORK-HOLDING IMPLEMENT AND BENCH-MOUNTED LOADING FIXTURE THEREFOR

BACKGROUND OF THE INVENTION

1. Field of the Invention

This invention generally relates to the field of work-holding tools and fixtures and, more particularly, to a work-holding implement for holding a cylindrical object while an interior bore is being honed or otherwise machined, as well as a bench-mounted fixture for loading the implement.

2. Description of the Related Art

Small workpieces are frequently held with the fingers in order to perform operations such as honing the interior surface of a bore in the workpiece. The lack of stability in such an approach is obvious, and the chance of marring the surface worked on or of possibly deforming a thin-walled workpiece clearly exists. If the machining operation is being carried out under an oil spray, the workpiece becomes slippery and difficult to hold. In addition, holding a workpiece with the fingers against high-speed rotating machinery is an inherently risky procedure from the standpoint of operator safety.

Implements exist which make use of a sheet of emery paper wrapped around a cylindrical workpiece and clamped rigidly in some sort of fixture. When this sort of device is employed while machining an interior bore of the workpiece, an extreme concentration of stress develops along a line as rotational torques force the workpiece against the clamping fixture. The workpiece is likely to become dented in response to the line of concentrated stress.

It would be a great boon in machine shop practice if there existed an implement for holding a workpiece for honing or other types of machining the inside of a bore in the object. Ideally such an implement could be used without damaging the outer surface of the object while providing sufficient stability and holding strength, even when an oil spray is present. Such a work-holding implement would be even more valuable if it were convenient to use and economical to manufacture. It would also be advantageous if such a work-holding implement had the capability of gripping a deformable object over its entire outer circumference without distorting its shape because of contact pressure concentrated at just a few points.

A further advantage would be gained by being able to load the workpiece into the implement in a fixture mounted on a workbench, so that insertion or removal of the workpiece could be accomplished with ease.

SUMMARY OF THE INVENTION

A work-holding implement for use in honing or otherwise machining the inner surface of a bore in an object is disclosed which has all of the desirable advantages listed above. In addition, a fixture to be used in conjunction with the implement and mounted to a bench is described.

The implement of the invention includes a torsion-carrying spring band coil mounted at one end of a handle. The innermost turn of the coil has a gripping material over most of its inwardly exposed surface. The remaining turns in the coil have smooth bearing surfaces which allow the coil to become more tightly wound in response to rotational torques exerted on an interior bore in a cylindrical object being gripped by the implement as it is worked on. An outer end of the coil wraps around an end portion of the handle in an angled bend and passes through a slot in the handle to form a planar portion extending along an outer segment of the handle. The outermost turn of the coil bears against the planar portion of the spring band when the implement is being used. When an object is being held by the implement and worked on, the tightened coil bears against the planar portion of the spring band which deforms slightly to conform to the curved surface over which contact is made, thereby spreading the contact forces over an extended surface of the workpiece.

Two band control guides extend transversely to either side of t he innermost turn of the torsion-carrying coil at its inner end. The ends of the control guides are curved concavely toward the center of the coil to provide a grip for the fingers or to engage a fixture for opening the coil, which is somewhat smaller than the workpiece when in its relaxed position. The control guides serve to keep the turns of the coil in alignment for proper pressure distribution of the innermost coil in its contact over the surface of a workpiece.

A loading fixture for use in conjunction with the work-holding implement comprises a mounting plate for attachment to a workbench and for supporting a multifaceted column, with a locator plate at the end of the column for supporting the workpiece. A generally L-shaped frame moves up and down on the faceted column and can be fixed in a selected position by means of a knob with a threaded screw portion, the end of which bears against one of the facets of the column when the knob is tightened. An angle bracket for holding the implement is attached to the free end of the L-shaped frame, with a stop plate projecting at right angles from the bracket. The faceted column is able to rotate in a hole in the mounting plate in which it is held by a clamping screw. The loading fixture can thus be rotated and locked in the most convenient position for use.

BRIEF DESCRIPTION OF THE DRAWING

A better understanding of the present invention may be realized from a consideration of the following detailed description, taken in conjunction with the accompanying drawing in which.

DESCRIPTION OF THE PREFERRED EMBODIMENT

Figure 1:
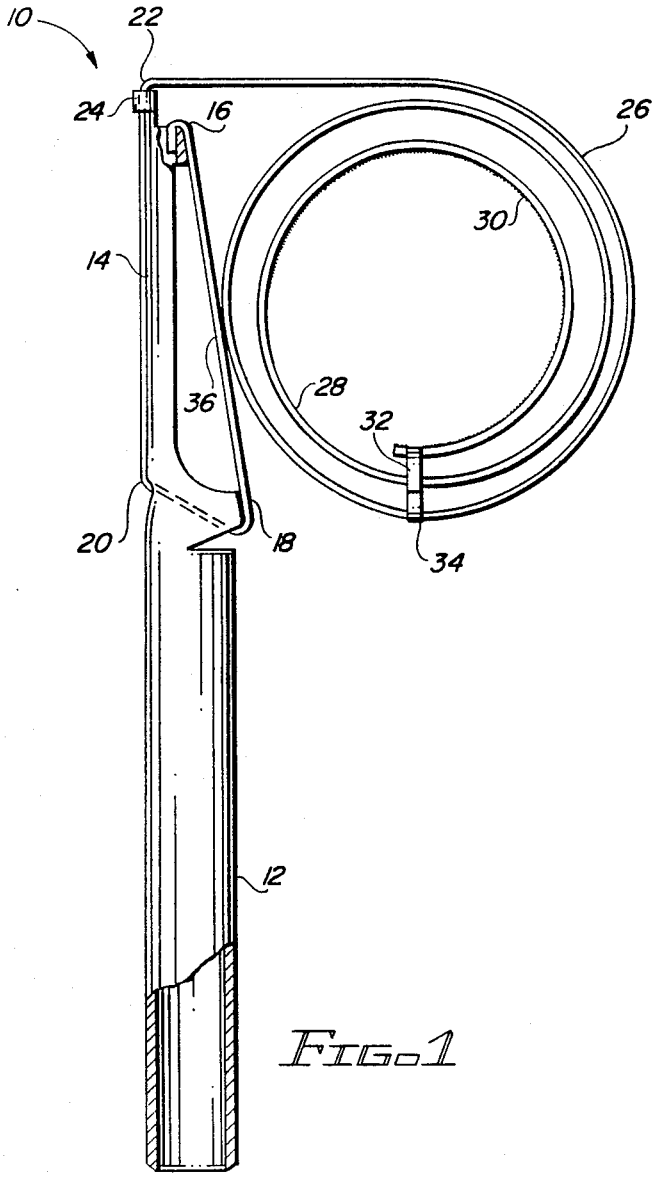
FIG. 1 is an elevational side view of the work-holding implement of the present invention.
Figure 2:
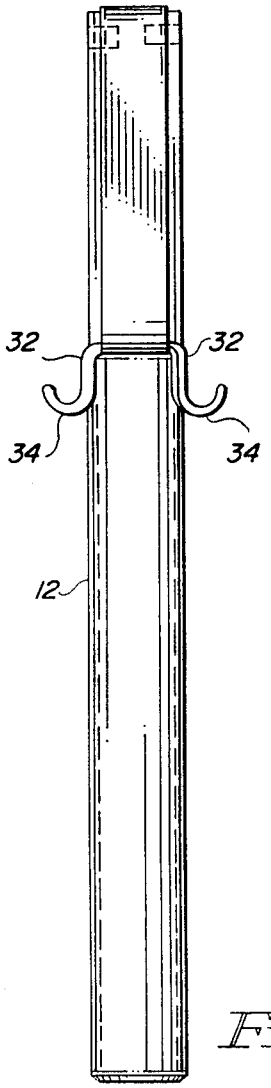
FIG. 2 is an elevational end view of the implement.
Figure 3:
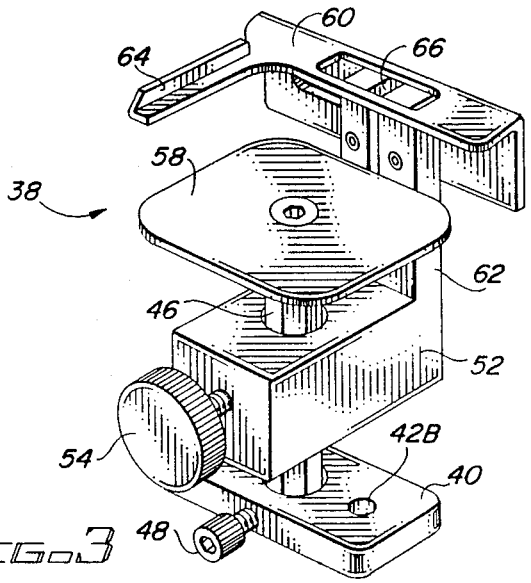
FIG. 3 is a perspective view of the loading fixture of the present invention.
Figure 4:
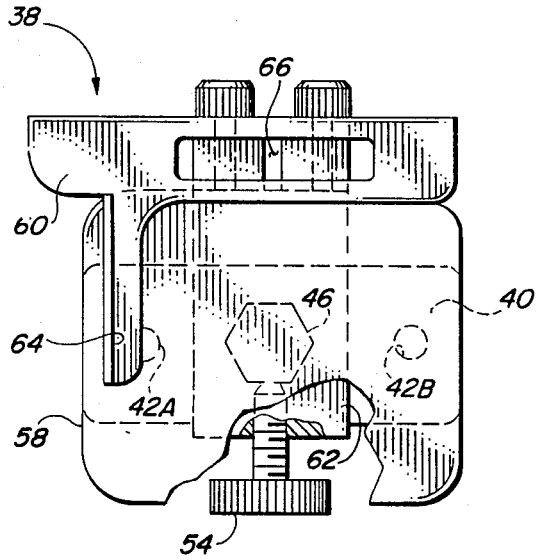
FIG. 4 is a top plan view, partially broken away, of the loading fixture of the present invention.
Figure 5:
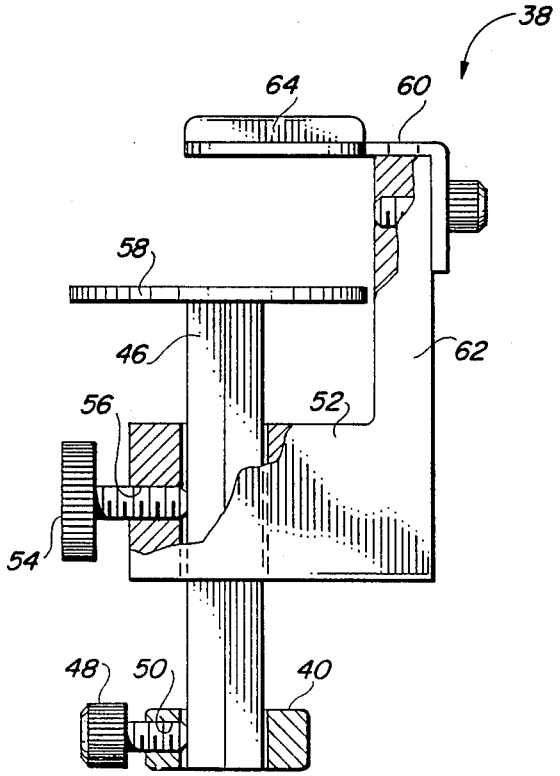
FIG. 5 is a front elevational view, partially broken away, of the loading fixture.
Figure 6:
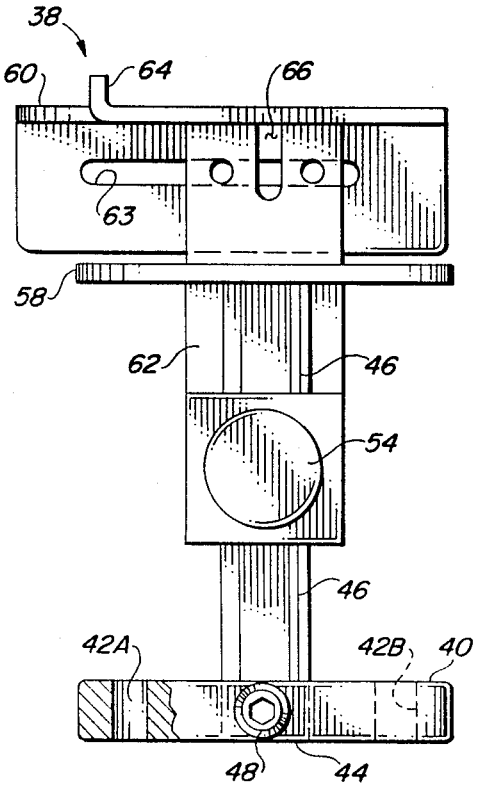
FIG. 6 is a side elevational view, partially broken away, of the loading fixture.

A work-holding implement in accordance with the present invention is shown in FIGS. 1 and 2. The implement 10 comprises a handle 12 terminating at one end in a narrowed-down portion 14. A band of spring steel is attached at a point 16 near the narrowed-down portion 14. The spring band forms a planar segment 18 before passing through a slot 20 in handle 12, follows the surface of narrowed-down portion 14 to form a roughly triangular configuration, and is then bent at right angles over the tip 22 of narrowed-down portion 14, with guiding tabs 24 serving to define the lateral position of the spring band as it passes over tip 22. The spring band then forms a coil composed of one or more outer turns 26 and an innermost turn 28. The inwardly directed surface of innermost coil 28 has a gripping surface 30. Such a gripping surface 30 can be produced by distributing an abrasive grit of hard sharp particles on an adhesive layer applied to the surface of the spring band.

The gripping surface is present over something less than a complete circumference of the innermost turn because the diameter of the innermost turn increases when a workpiece is inserted into the turn and decreases when torques are applied to an internal bore of the workpiece by rotating machine tools. The surfaces of outer turns 26 are smooth bearing surfaces so that they can slip with respect to each other and an overall tightening of the coil can be effected. Band control guides 32 at the end of innermost turn 28 of the spring band coil serve to keep the turns of the coil in alignment with each other. As shown in FIG. 2, band control guides 32 have straight portions bearing against the coil edges to limit the lateral movement of turns 26 and 28 of the spring band coil. The straight portions of band control guides 32 terminate in hooked portions 34 which are adapted to being gripped by the fingers to allow insertion or removal of a workpiece.

The superior gripping capability of the work-holding implement and the lack of any excess stress concentration at any particular point on the circumference of a cylindrical object being held derive from the following sequence of events. After a workpiece is inserted into the central space of the spring band coil, the gripping surface 30 of innermost turn 28 grasps the object lightly through the spring action of the coil which urges the inner end of the coil radially inward. When a rotating hone (for example) is brought into contact with an interior bore in the workpiece, if the orientation of the workpiece is chosen properly with respect to the axis of rotation of the hone the friction between the innermost turn of the coil and the workpiece results in a tightening of the spring band coil. The tightening action is facilitated by the smooth bearing surfaces of outer turns 26 in the coil. The forces on the workpiece due to the tightening coil are all directed radially inward and distributed evenly over the circumference of the innermost turn 28. In addition, part of the outermost turn bears against the planar portion 18 of the spring band initially at the line of contact 36. Spring band portion 18 becomes deformed, however, so that contact is made over a segment of the circumference of the outermost turn of the coil.

A loading fixture for facilitating easy and rapid insertion or removal of a workpiece into the holding implement is depicted in FIGs. 3–6. A mounting plate 40 has first and second mounting holes 42A, 42B for mounting to a workbench with screws or bolts. A centrally located hole 44 through mounting plate 40 accommodates a multifaceted column 46, the orientation of which is fixed by set screw 48 which bears against one of the facets through a threaded hole 50 in mounting plate 40. A generally L-shaped frame 52 is free to move on faceted column 46, with its position being fixed by the threaded screw portion of knob 54 which bears on the column through hole 56 in frame 52.

A locator plate 58 is attached to the top of faceted column 46 as a support for the workpiece to be inserted into or removed from the work-holding implement 10. An angled bracket 60 has a slot 63 through which mounting screws attach bracket 60 to a vertical arm 62 of L-shaped bracket 52. The positioning of bracket 60 with respect to arm 62 of frame 52 is used to accommodate loading fixture 38 to various sizes of work-holding implements 10. A stop plate 64 which extends at right angles from bracket 60 is set a distance from the center of locator plate 58 which is roughly equal to half the diameter of the workpiece. A vertical slot 66 has a width which matches that of end 34 of band control guide 32 (FIG. 2). When loading fixture 38 is being used in conjunction with implement 10, handle 12 is held in a roughly horizontal position with the coil adjacent stop plate 64, as the lower band control guide 34 is inserted in slot 66 in FIG. 3. As the handle 12 is moved clockwise (looking down on the fixture 10) in a horizontal plane, the spring band coil starts to open up and the outermost turn bears against stop plate 64. When the innermost turn of the spring band coil opens to a large enough diameter, a workpiece can be either inserted or removed from the implement 10.

Although there have been described hereinabove various specific arrangements of a work-holding implement and a bench-mounted loading fixture in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A work-holding implement comprising:

a handle; and multi-turn torsion spring means for holding a circular workpiece including an inwardly facing gripping surface along a first portion and slidable bearing surfaces along a second portion thereof, said means being attached at one end to said handle, the other end being biased radially inwardly to frictionally engage a circular workpiece positioned therein;

said spring means comprising:

a spirally wound spring band coil having an innermost turn and at least one outer turn, with most of an inner circumference of said innermost turn having a gripping surface; and first and second band control guides extending radially outward from said innermost turn to adjacent an outermost turn of said coil.

2. The implement of claim 1 wherein an outer end of said coil passes around a portion of said one end of said handle, passes through a slot in said handle, across an open space, and is fixed to said handle near a tip of said end of said handle to form a roughly triangular configuration, one side of which is adjacent said outer turn of said coil.

3. The implement of claim 1 wherein said gripping surface comprises an abrasive grit held in an adhesive layer on said surface.

4. A work-holding implement comprising:

a handle; and multi-turn torsion spring means for holding a circular workpiece including an inwardly facing gripping surface along a first portion and slidable bearing surfaces along a second portion thereof, said means being attached at one end to said handle, the other end being biased radially inwardly to frictionally engage a circular workpiece positioned therein;

wherein said handle comprises metallic tubing with a flattened single-wall extension at one end thereof.

5. The implement of claim 4 wherein said spring means for holding a workpiece comprises a spirally wound spring band coil having an innermost turn and at least one outer turn, with most of an inner circumference of said innermost turn having a gripping surface.

6. The implement of claim 2 wherein said one side constitutes a section of said outer end of said coil which passes across said open space, said section being maintained in tension to provide a resilient support for said spring means which is adapted to deform under pressure from the spring means holding a workpiece and distribute the bearing load between said spring means and said section along an extended portion of the outer turn of the coil and workpiece.

7. The implement of claim 1 wherein said slidable bearing surfaces comprise facing surfaces of the multiple turns of said torsion spring means including the outer surface of the innermost turn and the inwardly facing surface of the turn adjacent the innermost turn.

8. A work-holding implement comprising:

a handle means;

a spring band means for holding a workpiece coupled to the handle means; and flexible bearing means mounted to said handle and extending from said spring band means;

wherein said spring band means bears against said flexible bearing means as said implement is being used; and wherein said handle comprises a generally elongate shape with a flattened portion at one end thereof and a slot through said flattened portion, said bearing means comprises a spring band attached to a tip of said flattened portion and spanning a space between said tip and a part of said handle adjacent said slot to form a resilient planar portion, said band passing through said slot and around said flattened portion through a right-angle bend, and said spring band means comprises a coil of an innermost turn and at least one outer turn, an interior surface of said innermost turn having a gripping material affixed thereto, with said coil being wound toward said handle and adjacent to said straight portion of said spring band, said coil being contiguous with said band after undergoing said right-angle band.

9. The implement of claim 8 further comprising first and second band control guides extending transversely on opposite sides of said spring band at an inner end of said coil.

* * * * *